United States Patent [19]

Beckey

[11] 4,054,810

[45] Oct. 18, 1977

[54] FIELD EMISSION ION SOURCE HAVING HEATED ANODE

[75] Inventor: Hans-Dieter Beckey, Bonn, Germany

[73] Assignee: Varian MAT GmbH, Germany

[21] Appl. No.: 702,766

[22] Filed: July 6, 1976

Related U.S. Application Data

[63] Continuation of Ser. No. 160,123, July 6, 1971, abandoned, which is a continuation of Ser. No. 670,818, Sept. 26, 1967, abandoned.

[51] Int. Cl.[2] ..... H01J 39/34

[52] U.S. Cl. ..... 313/15; 313/363; 313/359

[58] Field of Search ..... 313/363, 15, 230, 359; 315/111.3, 111.8

[56] References Cited

PUBLICATIONS

Robertson et al., "British Journal of Applied Physics", 1963, vol. 14, pp. 278–283.

*Primary Examiner*—Rudolph V. Rolinec
*Assistant Examiner*—Darwin R. Hostetter
*Attorney, Agent, or Firm*—Wolf, Greenfield & Sacks

[57] ABSTRACT

A field emission ion source of the type employing a thin anode having an elongated surface utilizes local heating of the anode to prevent material from being adsorbed on the anode's surface. The anode may be a wire or a thin knife-edged metal strip through which an electrical current is passed to heat the anode.

3 Claims, 6 Drawing Figures

Fig. 1
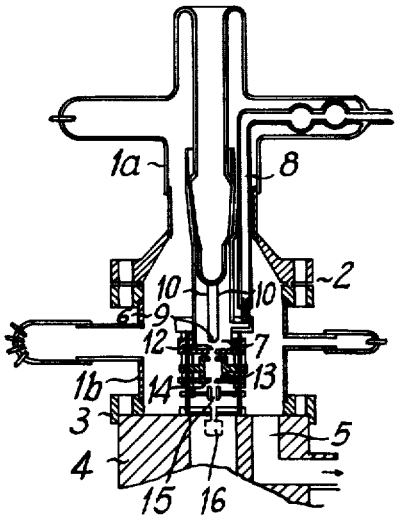
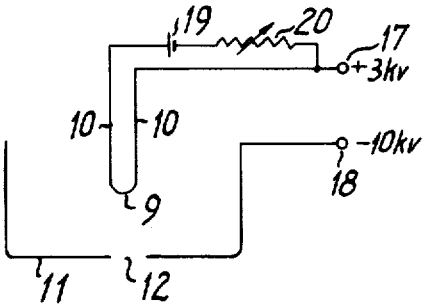
Fig. 2

FIELD EMISSION ION SOURCE HAVING HEATED ANODE

This application is a continuation of my earlier application Ser. No. 160,123 of July 6, 1971, now abandoned, which in turn was a continuation of my parent application Ser. No. 670,818 of Sept. 26, 1967, which was also abandoned.

This invention relates in general to field emission ion sources of the kind employed in mass spectrometry. More particularly, the invention relates to field emission ion sources employing an anode having an elongated surface. A field emission in source of that type is disclosed in my U.S. Pat. No. 3,313,934.

Relative to the field emission ion source which uses an anode having fine metal points to produce the high intensity electric field, the field emission ion source which employs an anode having a thin elongated surface has substantial advantages because (1) it provides a larger field ion current and (2) the emission fluctuations are smaller so that stabilization of the ion current is promoted.

It has been found, however, that the resolving power obtained with a mass spectrometer using a field emission ion source of the type having a thin elongated anode is far from ideal. In connection with the mass spectrometric analysis of solid substances, fragment ions with relatively high intensities appeared. For example, comparative measurements of the mass spectrum of acetone, performed with a field emission ion source having a point anode and with a field emission ion source having a thin wire anode, showed the ratio of mass 59 to mass 58 to be more than three times larger than the theoretical value (0.033) of the isotope ratio. Moreover, the lines of mass numbers 43 and 41 in the acetone's mass spectrum occurred with a relative intensity of 0.0030 and 0.0050 respectively, when a wire anode ion source was used as compared with a relative intensity of 0.001 or less when the conventional pointed anode was used.

The objective of the invention is to provide an improved field emission ion source of high ion yield which supplies clean field-ion mass spectra.

The invention is derived from the consideration that a strongly increased P + 1 ion concentration in the mass analysis of acetone must be based on the molecular reaction.

$$P^+ + P = (P + 1)^+ + P - 1$$

where $P$ = parent ions

From this, it can be concluded that the decrease in resolving power and the increase in the production of fragment ions is due to the larger surface associated with elongated wire anode. The invention resides in the discovery that localized heating of the anode to prevent condensation on the anode's surface achieves a marked improvement in analytical results. For example, employing a wire anode having a diameter of 2.5$\mu$ in the mass spectral analysis of acetone, the ratio of mass 59 to mass 58 (M + 1)/M, where M = molecular ions) was determined to be 0.143 with an unheated anode. In contrast, when the anode was locally heated with an electrical current of 0.85mA, the ratio of mass 59 to mass 58 was reduced to 0.042 which is only slightly more than the theoretical isotope ratio of 0.003. Further the relative intensity of fragment ions of mass numbers 43 dropped from 0.00300 to 0.00126 and the relative intensity of fragment ions of mass number 41 dropped from 0.00530 to 0.00142, while the absolute intensity of the molecular in peak remained substantially unchanged.

THE DRAWINGS

FIG. 1 shows a field emission ion source having an elongated anode;

FIG. 2 schematically depicts the preferred arrangement for locally heating the anode;

Figure 5:
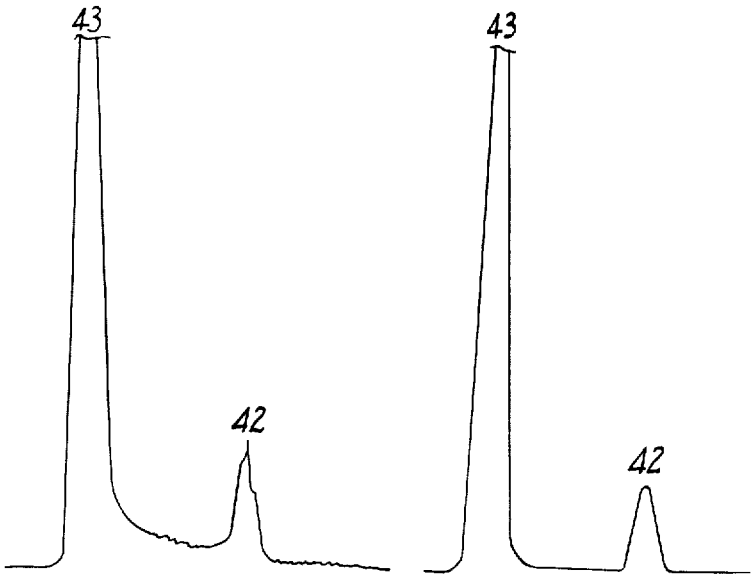
Figure 6:
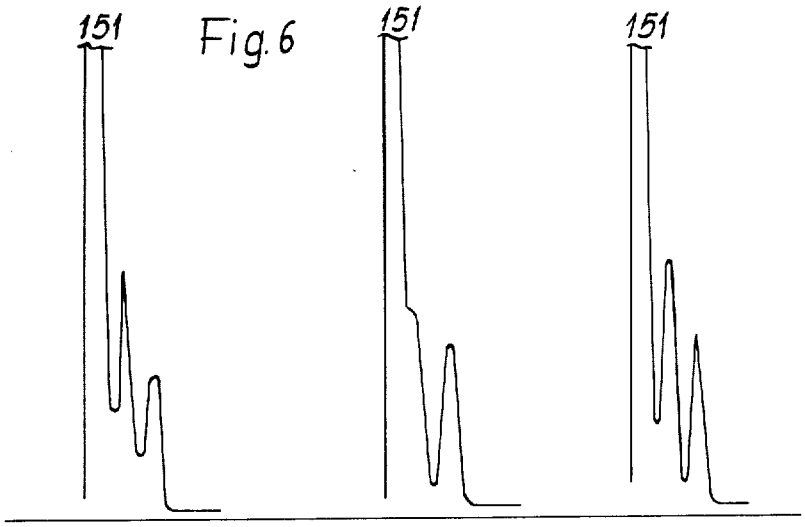

FIG. 5 graphically shows the spread toward lower masses occurring in the mass spectra of organic molecules when the anode is heated to prevent condensation on its surface as compared with an unheated anode;

FIG. 6 shows part of the mass spectrum of d-Ribose obtained in a mass spectrometer utilizing a field emission ion source and shows the improved resolution resulting from heating of the anode.

THE EXPOSITION

FIG. 1 depicts the construction of a field emission ion source having a wire anode. The structure employs a two-part cylindrical glass housing 1*a*, 1*b* having a flanged connection 2 at which the two parts are joined. The housing is open at one end which is provided with a flange 3 to permit the housing to be mounted upon a member 4. The member 4 has a central passage leading to a mass spectrometer and the member 4 may be the mass analyzer tube of the spectrometer. To permit a high vacuum to be established and maintained in the housing, the spectrometer tube 4 is provided with a passage 5 through which a vacuum pump can apply suction to exhaust the interior of the housing. Within the evacuated space 6 in the housing is an ionization chamber 7 in which field ionization occurs. The material to be ionized is introduced into the ionization chamber through a supply pipe 8. In the ionization chamber is an anode 9 which can be a Wollaston wire of the form described in my aforesaid U.S. patent. Instead of a wire, the anode may be constituted by a thin metal foil or by a strip having a knife edge. Opposite the anode is a cathode 11 having in it a slot 12 through which ions in the chamber 7 can exit. The anode may, for example, be placed at a potential of +4KV relative to ground while the cathode is placed at a potential of −10KV relative to ground to create an intense electric field at the anode. The electric field strength is increased appreciably by employing a wire anode having a very small radius of curvature. In the field ion source, electrons are caused to disassociate from the molecules which are in the intense electrical field adjacent to the anode. The extracted electrons are drawn to the anode whereas the ions are drawn toward the cathode. With the aid of an electrostatic lens, constituted by the cathode 11 and lens electrodes 13 and 14, the ions are drawn out of the ionization chamber as a divergent beam and are focused onto the admitting aperture of the mass spectrometer tube 4. The ion beam can be adjusted in two orthogonal directions by pairs of deflection plates 15 and 16 between which the beam passes. A fuller description of the focussing arrangement is given in my aforesaid U.S. patent.

For the analysis of solids, a vaporization oven can be provided having an exit towards the anode 9 which is approximately 5 mm away. The arrangement of the acceleration and focussing electrodes is such as to permit molecules from the vaporization oven to enter the ionization chamber without being intercepted by those electrodes.

The anode 9 is a Wollaston wire, preferably of 2.5μ diameter, having a free length of 5 mm. A process for making a suitable Wollaston wire is described in my aforesaid U.S. Patent. While a Wollaston wire is preferred, where the wire is made of other material, it should have a diameter in the range of 2.5 to 10.0μ. A high potential is applied to the anode 9 through connecting lines 10 which may also act to support the wire anode at its ends. As indicated in FIG. 2, a high potential of +4KV is applied at terminal 17 to the lines 10 and a potential of −10KV is applied at terminal 18 to cathode 11. To provide for local heating of the anode 8, a direct current source 19 and a current limiting resistor 20 are placed in circuit with the lines 10. Inasmuch as the lines 10 are +4KV above ground potential, the direct current source and its current limiting resistor are also at that same potential. It is necessary, therefore, to insulate the direct current source and the resistor 20 to maintain them at the high positive potential. The current flowing through the anode 9 is adjusted by current limiter 20 to a value sufficient to heat the anode 9 to a temperature where appreciable adsorption on the anode of the material being ionized does not occur. Usually, the anode is heated to a temperature of 150° C or thereabouts. Further, the vacuum in the chamber is high enough to prevent the occurrence of ionization by gas discharge. The anode 9 is heated to a temperature such that the vaporous or gaseous material in the ionization chamber does not condense upon the anode's surface. Thus the material being ionized is prevented from forming a film on the anode so that ionization occurs principally in front of the anode rather than on the anode.

When the anode 9 is not heated or is insufficiently heated, substances which are difficult to vaporize have a tendency to condense upon the anode and form solid deposits on it. The solid deposits interfere with the electric field potential at the anode's surface by creating layers of undefined electric potential. This variation of electric potential results in the reduction of resolving power.

Figure 3:
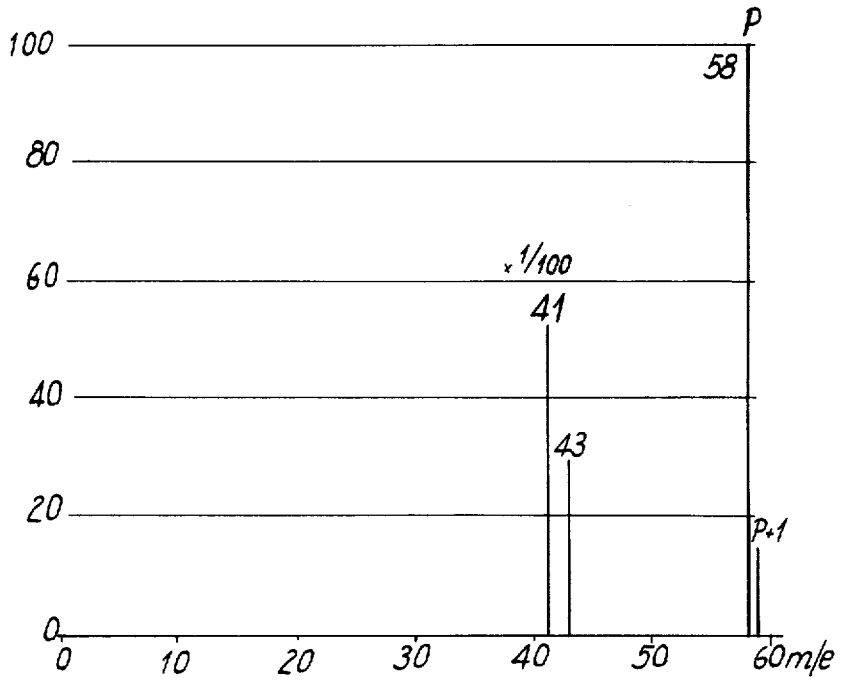
FIG. 3 shows the mass spectrum of acetone obtained in a mass spectrometer utilizing a field emission ion source employing an unheated anode.
Figure 4:
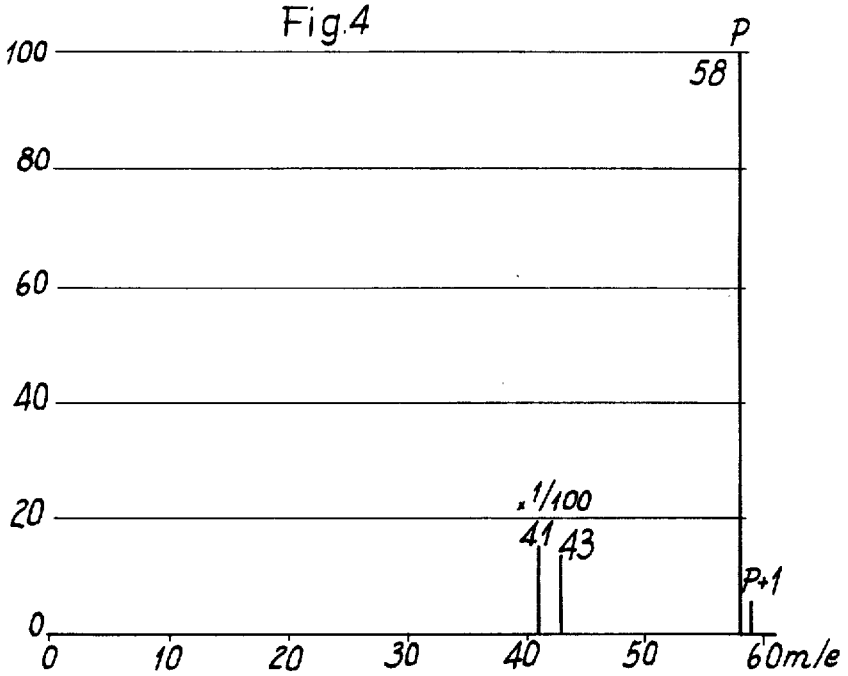
FIG. 4 shows the mass spectrum of acetone obtained with the same arrangement when the anode is heated.

FIG. 3 shows the mass spectra of acetone obtained with a field emitter ion source using an unheated anode and FIG. 4, by way of contrast, shows the mass spectra of acetone obtained with a heated anode. The ion molecule reaction $P^+ + P = (P + 1)^+ + P - 1$, which as a strongly increased $P + 1$ ion concentration, is brought about with an unheated anode and occurs in the condensed layer on the surface of the Wollaston wire. When the anode is heated sufficiently to prevent the formation of the surface layer, the field ionization occurs in the gas phase in front of the anode. Also, the relatively large frequency of fragment ions of mass numbers 43, 41 which are obtained with an unheated anode result mainly from surface reactions in the adsorbed molecular layer on the anode's surface. By heating the anode to increase the anode's temperature, surface reactions are substantially reduced and therefore the intensity of fragment ions is lessened. Heating of the anode is of particular interest in investigations where it is desired to maintain the intensity of fragment ions as small as possible in the field ion mass spectrum. For example, in an investigation to detect very low concentrations of free radicals. The view that fragments are formed principally by reactions occurring at the surface of the unheated anode whereas with a heated anode the fragments are produced mainly by field dissociation in the gaseous phase, is strengthened by the results graphically shown in FIG. 5. From a comparison of the left and right graphs, it can be seen that the fragment mass lines are obviously different. The graph at the right was obtained with an unheated anode and shows the form of mass line $M = 43$ to be approximately symmetrical. With a heated anode, the mass line, as shown in the graph at the left, exhibits a spread toward lower masses. That manifestation is characteristic of the field dissociation of organic molecules in the gaseous phase.

The improvement of resolving power obtained with a heated anode is shown by the graphs of FIG. 6. The graph at the left shows the molecular ion peak and adjoining peaks of of d'Ribose obtained with an unheated anode and a molecular ion beam formed before an appreciable condensate could deposit on the unheated anode. The center graph was obtained some five minutes later. The resolving power is clearly degraded in the center graph. The graph at the right was obtained after the anode had been heated by passing an electrical current through it to destroy the film deposited on the anode. The resolution capability, as can be seen, is substantially improved.

While a preferred embodiment of the invention has been disclosed, it is evident that the invention can take other forms. It is evident that the anode can be heated in different ways and need not be heated solely by passing an electrical current through a wire anode. For example, the anode can be heated by irradiation. Further, the wire can be replaced by a thin metal foil, or a narrow strip of blade, such as a razor blade strip of about 5 mm length and 1 mm width.

I claim:

1. A method of obtaining low fragment ion yield from a field emission ion source of the type having a. an evacuated ionization chamber, b. a cathode c. an anode having a thin elongated surface facing the cathode, and d. focussing means for forming an ion beam, the method including the steps of 1. placing the anode at a high electric potential relative to the cathode to create an intense electric field in the ionization chamber,
2. introducing a vaporous or gaseous sample into the ionization chamber, and
3. locally heating the anode to prevent condensation of the sample on the anode's thin elongated surface during the production of ions by field emission.

2. In a field emission ion source for ionizing gaseous or vaporous samples where the apparatus is of the type having a. an evacuated ionization chamber for containing the sample, b. a cathode, c. an anode having a thin elongated surface facing the cathode, and d. means for establishing an electric field between the anode and cathode of sufficient intensity to cause ionization of the sample by field emission, the improvement of means for locally heating the anode to a temperature which prevents condensation of the sample on the anode's thin elongated surface during the production of ions by field emission.

3. The field emission ion source according to claim 2, wherein the anode is a thin wire and the apparatus is of the type further including e. means for admitting a vaporous or gaseous sample into the evacuated ionization chamber, and the means for locally heating the anode is a source of direct current arranged to pass an electrical current through the thin wire whereby that wire is heated to a temperature which prevents the sample from condensing on the anode.

* * * * *